US009719182B2

(12) United States Patent
Agustoni

(10) Patent No.: US 9,719,182 B2
(45) Date of Patent: Aug. 1, 2017

(54) ELECTROFORM WELDING OF AN ELECTROFORMED TIMEPIECE SHELL

(71) Applicant: The Swatch Group Research and Development Ltd, Marin (CH)

(72) Inventor: Enzo Agustoni, Marin (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/799,874

(22) Filed: Jul. 15, 2015

(65) Prior Publication Data

US 2016/0017509 A1 Jan. 21, 2016

(30) Foreign Application Priority Data

Jul. 21, 2014 (EP) ..... 14177777

(51) Int. Cl.
*C25D 1/00* (2006.01)
*G04B 37/22* (2006.01)
(Continued)

(52) U.S. Cl.
CPC ..... *C25D 1/003* (2013.01); *C25D 1/02* (2013.01); *C25D 1/08* (2013.01); *G04B 37/04* (2013.01); *G04B 37/08* (2013.01); *G04B 37/22* (2013.01)

(58) Field of Classification Search
CPC ..... C25D 1/003; C25D 1/02; C25D 1/08
See application file for complete search history.

(56) References Cited

U.S. PATENT DOCUMENTS 8,025,782 B2 * 9/2011 Saucy ..... B81C 99/0085 205/67
2004/0231159 A1 * 11/2004 Shibuya ..... A44C 27/006 29/896.412

(Continued)

FOREIGN PATENT DOCUMENTS

CH 692 531 A5 7/2002
EP 0 716 360 A1 6/1996

(Continued)

OTHER PUBLICATIONS

European Search Report issued Jun. 3, 2015 in European Application 14177777, filed on Jul. 21, 2014 ( with English Translation).

*Primary Examiner* — Louis Rufo
(74) *Attorney, Agent, or Firm* — Oblon, McClelland, Maier & Neustadt, L.L.P.

(57) ABSTRACT

Method for manufacturing an electroformed timepiece component:

the same first alloy including a first precious metal is selected to make both functional inserts and an electroformed shell;

these inserts are made;

an electroforming substrate having a complementary profile to the inner profile of this component is formed in a second sacrificial material;

these inserts are inserted into housings made on this substrate, to form an equipped sacrificial substrate, which is provided with the resists necessary to obtain, by means of an electroforming process, a bare electroformed component, with deposition of material on this substrate, acting as a core to form this electroformed shell, and on each accessible surface of each insert to secure the insert to this electroformed shell;

(Continued)

then this sacrificial substrate is destroyed and all of these resists are removed.

13 Claims, 2 Drawing Sheets

(51) Int. Cl.

| | |
|---|---|
| ***G04B 37/08*** | (2006.01) |
| ***C25D 1/08*** | (2006.01) |
| ***G04B 37/04*** | (2006.01) |
| ***C25D 1/02*** | (2006.01) |

(56) References Cited

U.S. PATENT DOCUMENTS

| | | | | |
|---|---|---|---|---|
| 2007/0008824 | A1 | 1/2007 | Cretin | |
| 2014/0161298 | A1* | 6/2014 | Russell-Clarke ..... | C25D 1/02<br>381/380 |

FOREIGN PATENT DOCUMENTS

| | | | |
|---|---|---|---|
| EP | 0 762 240 | A1 | 3/1997 |
| EP | 1 742 120 | B1 | 1/2007 |

* cited by examiner

Fig. 5
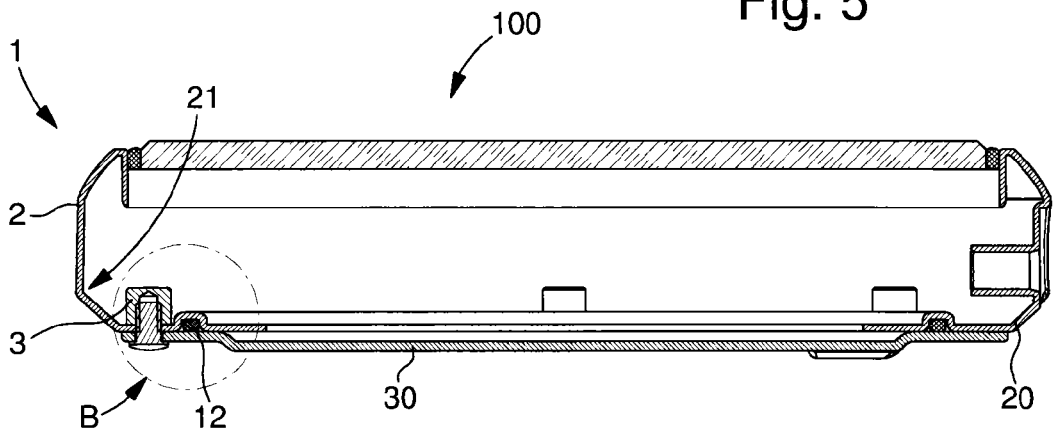
Fig. 6
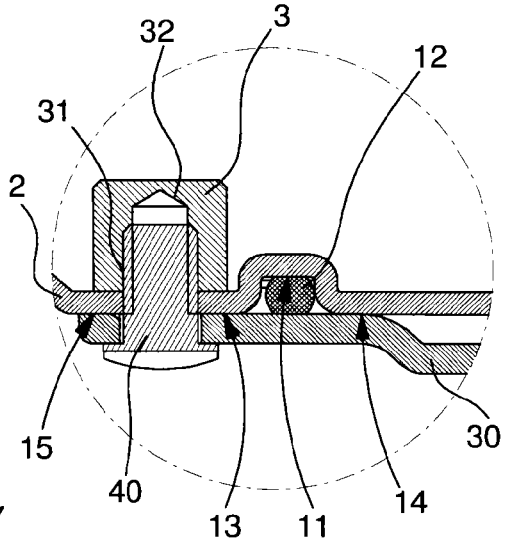
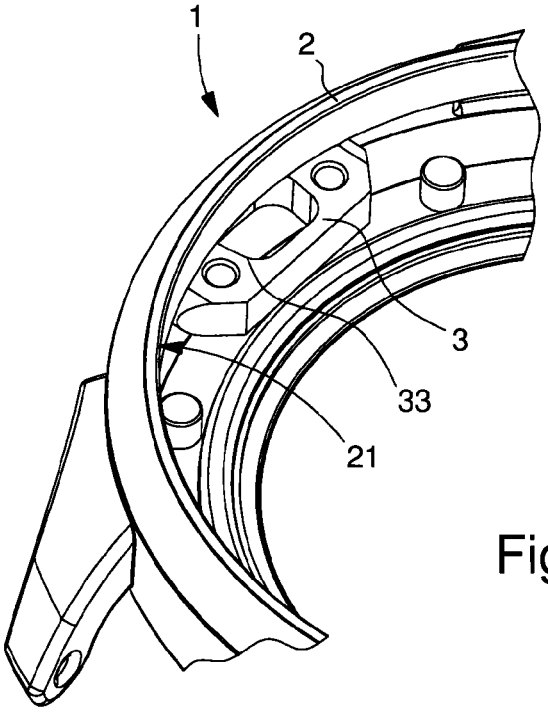
Fig. 7

ELECTROFORM WELDING OF AN ELECTROFORMED TIMEPIECE SHELL

This application claims priority from European Patent Application No 14177777.1 filed Jul. 21, 2014, the entire disclosure of which is hereby incorporated herein by reference.

FIELD OF THE INVENTION

The invention concerns a method for manufacturing an electroformed structural timepiece component.

The invention also concerns a timepiece, including an electroformed case middle which includes, in proximity to machined inserts each including a machined portion or an internal thread, at least a first continuous closed surface for housing a peripheral gasket, said first continuous closed surface being delimited by two adjacent surfaces of said case middle together forming a flat bearing surface.

The invention concerns the field of structural timepiece components, and more particularly thin components made of precious alloys, particularly gold alloys.

BACKGROUND OF THE INVENTION

Production of structural timepiece components by electroforming makes it possible to obtain perfect geometry, a good surface state and a flawless appearance, using a small amount of expensive material, due to the small thickness of the parts produced. In the case of external components (cases, links, bezels, and suchlike), the parts obtained are hollow shells, whose mechanical properties must be approved according to the application.

The resistance of such shells is related to their geometry, and it is clear that to obtain a reasonably rigid shell, including ribs, or horn-shaped stiffening members, it is necessary first to machine a substrate to be used as a core, which is of quite complex shape and consequently expensive. Otherwise, it is difficult for a non-stiffened shell to withstand assembly to other components, such as a back cover, horns, a bracelet or strap or other element, and is liable, at best, to be deformed to an extent that is detrimental to the sealing of the timepiece in which the shell will be incorporated, or at worst to tear or crack.

CH Patent No 692531 in the name of Maire discloses a watch case formed of a thin metallic wall, of substantially constant thickness. The wall defines, in a part forming a bezel, a cylindrical surface which circumscribes an upper opening closed by a crystal secured by a gasket to the wall, and an open groove on a housing for receiving a movement. A retaining ring is removably fixed inside the groove.

EP Patent Application No 0762240A1 in the name of Fabrique d'ébauches de Sonceboz SA discloses a container including a hollow case and a casing ring, with an electroformed case middle having thin precious metal walls, defining a concave inner face. The casing ring, which is made of cheaper material, is inserted into the case middle from the side of a back cover removably assembled to the case middle, separated by a recess from the inner face, and is held therein by compression between upper and lower bearing surfaces respectively defined by a portion of the inner face of the back cover, and by a portion of the inner face of the case middle EP Patent Application No 0716360A1 in the name of Fabrique d'ébauches de Sonceboz SA discloses a similar watch case wherein the upper and lower bearing surfaces are parallel to the back cover and wherein the casing ring may have a variable thickness during insertion or in the operating position, under the effect of mechanical means or of its own elasticity.

EP Patent Application No 1742120 A2 in the name of Richemont discloses a watch including a case with a fixed part and a movable part which includes a case middle and a movement, both pivotally mounted on the fixed part along a pivot axis by pivots to perform a tilting motion of the movable part in two opposite directions, achieved by pressure on one portion of the movable part. At least one activating mechanism cooperates with the fixed and movable parts to convert their relative tilting into an action on a control member accessible from the exterior of the movement and intended to activate at least one function.

SUMMARY OF THE INVENTION

The invention proposes to overcome these problems and to produce a structural component of improved rigidity.

To this end, the invention concerns a method for manufacturing an electroformed structural timepiece component according to claim 1.

The invention also concerns a timepiece including an electroformed case middle.

BRIEF DESCRIPTION OF THE DRAWINGS

Other features and advantages of the invention will appear upon reading the following detailed description, with reference to the annexed drawings, in which:

FIG. 5 shows, in a similar and partial manner, with a detail in

FIG. 6, a timepiece including the component of FIG. 3, which is a case middle, and on which is fixed, by means of at least one screw screwed into an insert, a back cover which bears on surfaces of the electroformed shell and compresses a sealing gasket into position.

FIG. 7 shows a variant with an insert including a functional surface in immediate proximity to an inner wall, which is impossible to achieve by machining, and easy to achieve with the invention.

DETAILED DESCRIPTION OF PREFERRED EMBODIMENTS

Figure 1:
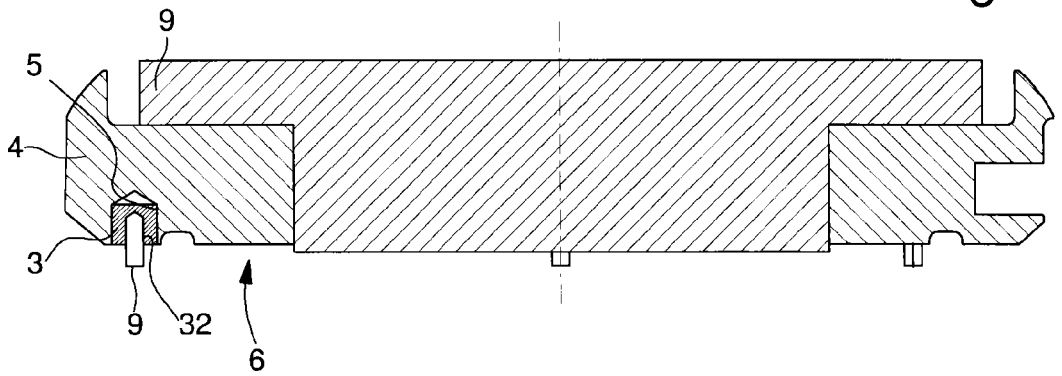
FIG. 1 shows a schematic cross-section of a sacrificial substrate implemented in the method of the invention, wherein a solid precious metal or precious metal alloy insert is assembled inside a housing in the substrate, said substrate is partially coated with a resist; the insert includes here a pierced hole also protected by a resist; the assembly forms an equipped sacrificial substrate, protected by the resists, and intended to be used as an electroforming core.
Figure 2:
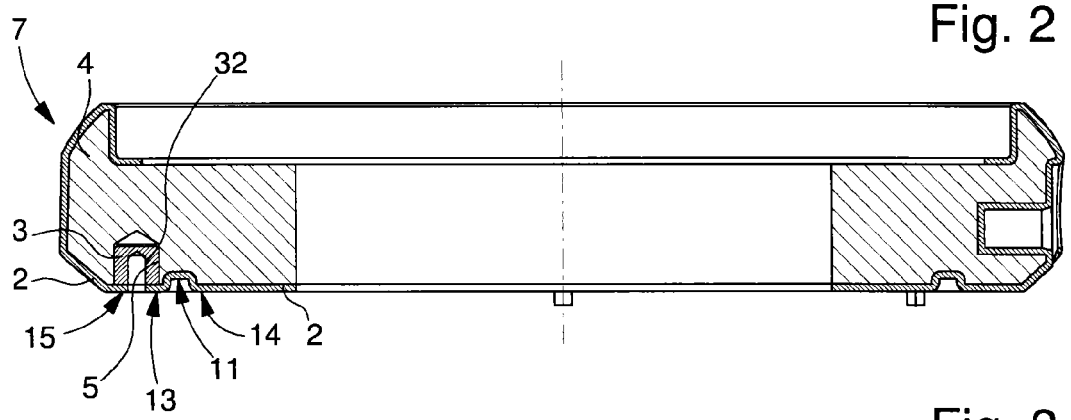
FIG. 2 shows, in a similar manner, the result, after a process of deposition, by means of an electroforming operation, of the same precious metal or precious metal alloy as that which forms the insert, after removal of the resists, and prior to destruction of the sacrificial substrate; at this stage an electroformed shell covers the substrate in the non-resist areas, and also covers the insert over its accessible surface.
Figure 3:
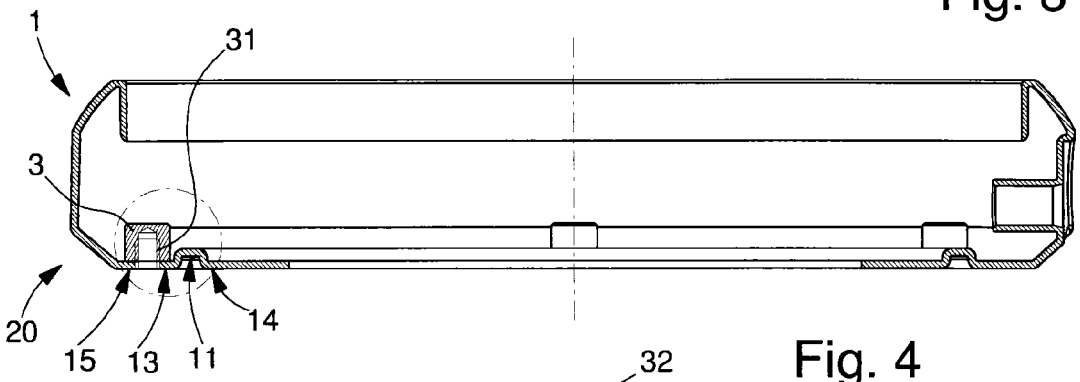
FIG. 3 shows, in a similar manner, the bare electroformed component subsequently obtained by destruction of the sacrificial substrate, and performing finish machining inside the insert through the portion of electroformed shell covering it, the finish machining being an internal thread here.
Figure 4:
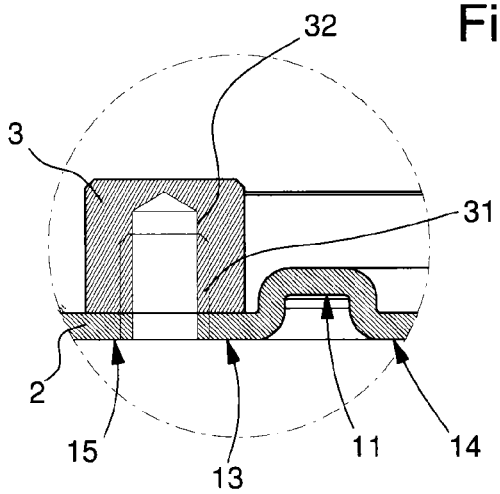
FIG. 4 shows a detail of this area, which is next to a sealing gasket receiving surface.

The invention proposes to produce an electroformed structural timepiece component, which is therefore of quite reduced thickness, on the order of several tenths of a millimeter, but nonetheless includes reinforced areas that are sufficiently solid to receive securing, closing, attachment, decorative or similar elements, these reinforced areas having sufficient rigidity to absorb the torsion and/or traction and/or shearing forces exerted by securing or similar means, to ensure suitable resistance to shocks, and to prevent any deformation or tearing of the electroformed shell forming the main part of the structural component concerned, and also to provide suitable shock resistance.

The invention also proposes to produce components with functional geometries that are impossible to achieve with conventional machining, in particular in areas with limited or no accessibility for a conventional tool.

To this end, the invention concerns a method for manufacturing an electroformed structural timepiece component 1.

According to the invention, the following operations are performed:

the same first alloy including a first precious metal is selected to form both solid functional inserts 3 and an electroformed shell 2;

inserts 3 are made by well known conventional methods;

there is made an electroforming substrate 4 having a complementary profile to the inner profile of component 1 from a second sacrificial material;

a housing 5 is made in substrate 4 to receive each insert 3;

the inserts are inserted into the corresponding housings 5 made in substrate 4 to form an equipped sacrificial substrate 6;

this equipped sacrificial substrate 6 is provided with resists 9 necessary to obtain, by means of an electroforming process, a bare electroformed component 7, with deposition of material on substrate 4, which acts as core, to form the electroformed shell 2, and on each accessible surface of each insert 3 to secure the insert to electroformed shell 2;

the electroforming is performed;

resists 9 are removed;

substrate 4 is destroyed.

Preferably, the first alloy including a first precious metal is selected with a fineness at least equal to that stamped on the finished component.

More specifically, in a preferred implementation of this method, the following steps are performed:

the method is applied to the manufacture of a hollow, electroformed, structural timepiece component with a given profile and including an electroformed shell 2 of substantially constant thickness, and:

there is defined at least one insert 3 intended to be incorporated in component 1 by electroform welding with electroformed shell 2;

a first metal is selected from a first so-called precious metal family, including gold, silver, platinum, rhodium, osmium, palladium, ruthenium, iridium, titanium, zirconium, and tantalum;

said same first alloy including at least one such first metal is selected to form both each said insert 3 and the electroformed shell 2;

each said insert 3 is formed solidly of the first alloy;

to make a sacrificial electroform substrate 4, a second sacrificial material is selected, either from the alloys of a second family including copper, tin, nickel, zinc, aluminium, magnesium, lead, manganese, chromium, arsenic and iron, or formed of a polymer charged with conductive particles, and/or coated with a conductive layer;

a said sacrificial substrate 4 having a complementary profile to the inner profile of structural component 1 is formed in said second material;

a housing 5 for receiving each said insert 3 is made on sacrificial substrate 4;

each said insert 3 is inserted or driven into its said corresponding housing 5, so as to form an equipped sacrificial substrate 6;

the resist or resists 9 necessary to obtain a bare electroformed component 7 are arranged on equipped sacrificial substrate 6 intended to be used as electroforming core;

an electroforming method is implemented to obtain a bare electroformed component 7 with the required sections of material on electroformed shell 2, with deposition of material on sacrificial substrate 4 acting as a core, and with deposition of material on each accessible surface of each insert 3, thereby securing each insert 3 to electroformed shell 2;

sacrificial substrate 4 is destroyed and all the resists 9 are removed.

In a particular manner, before destroying sacrificial substrate 4 and/or removing resists 9, at least one machining operation is performed on at least one such insert 3, and on the part of electroformed shell 2 that covers the insert locally.

In a variant, after having destroyed sacrificial substrate 4 and removed resists 9, at least one machining operation is performed on at least one such insert 3 and on the part of electroformed shell 2 that covers the insert locally.

According to a particular variant of the invention, a brass or zamak will be chosen as the second sacrificial material.

In another variant, the sacrificial substrate is made of polymer material charged with conductive particles, or of polymer material coated with a conductive layer by a well-known "electroless" method.

In a particular variant of the invention, this electroforming method is implemented to obtain a bare electroformed component by material growth towards both the exterior and interior of the sacrificial substrate, with the required sections of material.

In another variant of the invention, the sacrificial substrate is not necessarily an alloy, and it includes at least one material that conducts electricity, or is coated with a layer that conducts electricity. This sacrificial substrate may, in particular, include at least one polymer material charged with conductive particles, and/or coated with a conductive layer by a well-known "electroless" or other method, or include a plastic charged in a similar manner. The other steps of the method may be performed in a similar manner to the method described above with a sacrificial alloy, the only difference being the sacrificial substrate removal method.

According to a particular variant of the invention, a gold or platinum alloy is selected as the first alloy.

More specifically, an alloy comprising at least 75% by mass of gold is advantageously selected as the first alloy.

Naturally, the invention is applicable to any fineness of precious metal alloy, for example to a 14K gold alloy in countries where such alloys are more usual than the above 18K alloys.

According to a particular variant of the invention, electroformed shell 4 is made with sections of material comprised between 0.25 and 0.35 mm. Naturally, for some applications, such as decorations, preferably in superposition, the thickness may be less than the value of 0.25 mm, which is preferred for components requiring good mechanical resistance.

According to a particular variant of the invention, at least one such insert 3 is made with a pre-pierced hole 32.

According to a particular variant of the invention, the diameter of pre-pierced hole 32 is selected as a function of the thickness of the first alloy deposited during the electroforming operation, to obtain in the insert 3 concerned, in the bare electroformed component 7, a diameter compatible with finish machining of insert 3 by forming internal threads by tapping or by chip removal.

According to a particular variant of the invention, pre-pierced hole 32 is provided with a resist 9, which may be externally threaded beforehand or include similar machining allowing easy extraction thereof, before the electroforming operation is performed.

According to a particular variant of the invention, each said insert 3 is made with its smallest dimension at least five times greater than the thickness of the first alloy deposited during the electroforming operation.

The invention also concerns an electroformed structural timepiece component 1 made in accordance with any of the variants of the above method. According to the invention, this structural component 1 includes, in proximity to inserts 3, at least a first continuous closed surface 11 for the housing of a peripheral gasket 12, the first continuous closed surface 11 being delimited by two adjacent surfaces 13, 14 of component 1 together forming a planar bearing surface.

More particularly, this structural component 1 forms a case middle 20.

FIG. 7 shows a variant with an insert 3 including a functional surface 33 in immediate proximity to an inner wall 21, which is impossible to achieve by machining, and easy to achieve with the invention.

The invention also concerns a timepiece 100 including one such case middle 20. It more particularly concerns a back cover 30 including a second continuous surface 31. This second continuous surface 31 cooperates in abutment with the two adjacent surfaces 13, 14 and is arranged to exert a crushing force on a peripheral gasket 12 comprised in timepiece 100. Back cover 30 bears on a bearing and/or securing surface 15 of component 1 facing each insert 3, to which back cover 30 is secured by securing means 40 such as screws or similar, traversing back cover 30 and each cooperating with a machined portion 31, particularly an inner thread, comprised in such an insert 3.

This timepiece 100 is notably a watch.

What is claimed is:

1. A method for manufacturing an electroformed structural timepiece component, the method comprising:

selecting a first alloy including a first metal to make both inserts and an electroformed shell;

making said inserts;

forming a sacrificial electroforming substrate having a complementary profile to an inner profile of said timepiece component of a sacrificial material;

forming housings on said sacrificial electroforming substrate;

inserting said inserts into said housings made on said sacrificial electroforming substrate to form an equipped sacrificial substrate, arranging resists on said equipped sacrificial substrate;

depositing an electroformed shell made of said first alloy on said equipped sacrificial substrate, which acts as an electroforming core to form said electroformed shell, such that the electroformed shell is deposited on each accessible surface of each insert to secure the insert to said electroformed shell and to obtain a bare electroformed component through an electroforming process;

removing the resists; and destroying said equipped sacrificial substrate.

2. The method according to claim 1, wherein said electroformed shell has a substantially constant thickness, the method further comprising:

selecting the first metal from a first family including gold, silver, platinum, rhodium, osmium, palladium, ruthenium, iridium, titanium, zirconium, and tantalum;

selecting the sacrificial material to make the sacrificial electroforming substrate, either from alloys of a second family including copper, tin, nickel, zinc, aluminium, magnesium, lead, manganese, chromium, arsenic and iron, or formed of a polymer charged with conductive particles, and/or coated with a conductive layer.

3. The method according to claim 2, wherein brass or zamak is chosen as said sacrificial material.

4. The method according to claim 1, further comprising:

selecting a first metal from a first family including gold, silver, platinum, rhodium, osmium, palladium, ruthenium, iridium, titanium, zirconium, and tantalum;

selecting to form the sacrificial electroforming substrate an electrically conductive material including at least one polymer substrate charged with conductive particles and/or coated with a conductive layer;

selecting said sacrificial material including at least one second metal to form the sacrificial electroforming substrate.

5. The method according to claim 1, further comprising, before destroying said equipped sacrificial substrate and/or removing the resists, performing at least one machining operation on at least one said insert and on a part of said electroformed shell which covers the insert locally.

6. The method according to claim 1, wherein, after destroying said equipped sacrificial substrate and/or removing the resists, performing at least one machining operation on at least one said insert and on a part of said electroformed shell which covers the insert locally.

7. The method according to claim 1, wherein a gold or platinum alloy is selected as said first alloy.

8. The method according to claim 7, wherein an alloy including at least 75% by mass of gold is selected as said first alloy.

9. The method according to claim 1, wherein said electroformed shell is made with sections of material comprised of a thickness between 0.25 and 0.35 mm.

10. The method according to claim 1, wherein at least one said insert is made with a pre-pierced hole.

11. The method according to claim 10, wherein a diameter of said pre-pierced hole is selected as a function of a thickness of said electroformed shell deposited during said electroforming, to obtain on said at least one insert, in said bare electroformed component, a diameter compatible with finish machining of said insert by forming internal threads by tapping.

12. The method according to claim 10, wherein said pre-pierced hole is provided with said resist before said electroforming operation is performed.

13. The method according to claim 1, wherein each said insert is made with a smallest dimension thereof at least five times greater than a thickness of said electroformed shell deposited during said electroforming.

* * * * *